US010581158B2

(12) United States Patent
Foo

(10) Patent No.: US 10,581,158 B2
(45) Date of Patent: Mar. 3, 2020

(54) ELECTRONICALLY BEAM-STEERABLE, LOW-SIDELOBE COMPOSITE RIGHT-LEFT-HANDED (CRLH) METAMATERIAL ARRAY ANTENNA

(71) Applicant: Senglee Foo, Ottawa (CA)

(72) Inventor: Senglee Foo, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 14 days.

(21) Appl. No.: 16/040,137

(22) Filed: Jul. 19, 2018

(65) Prior Publication Data

US 2020/0028254 A1 Jan. 23, 2020

(51) Int. Cl.

| | |
|---|---|
| ***H01Q 1/52*** | (2006.01) |
| ***H01Q 1/38*** | (2006.01) |
| ***H01Q 21/22*** | (2006.01) |
| ***H01Q 1/24*** | (2006.01) |
| ***H01Q 3/36*** | (2006.01) |

(52) U.S. Cl.

CPC ..... *H01Q 1/528* (2013.01); *H01Q 1/243* (2013.01); *H01Q 1/38* (2013.01); *H01Q 3/36* (2013.01); *H01Q 21/22* (2013.01)

(58) Field of Classification Search

CPC ..... H01Q 1/528; H01Q 1/243; H01Q 1/38; H01Q 3/36; H01Q 21/22

See application file for complete search history.

(56) References Cited

U.S. PATENT DOCUMENTS

| | | | | |
|---|---|---|---|---|
| 8,686,902 | B2 * | 4/2014 | Lopez | H01Q 1/243 343/700 MS |
| 2008/0258993 | A1 * | 10/2008 | Gummalla | H01Q 1/243 343/876 |
| 2009/0135087 | A1 * | 5/2009 | Gummalla | H01P 3/02 343/909 |

(Continued)

FOREIGN PATENT DOCUMENTS

| | | | |
|---|---|---|---|
| CN | 107534221 | A | 1/2018 |
| WO | 2011078584 | A2 | 6/2011 |

OTHER PUBLICATIONS

Senglee Foo et al. Electronically steerable, low-sidelobe, CRLH-metamaterial leaky-wave antenna, 13th European Conference on Antennas and Propagation (EuCAP 2019), total 4 pages.

(Continued)

*Primary Examiner* — Hoang V Nguyen

(57) ABSTRACT

A high-gain, low-sidelobe, beam-steerable antenna includes a liquid-crystal loaded composite right- and left-handed (CRLH) metamaterial array. The metamaterial array includes a pair of first and second rows of unit cells, to propagate a radiation pattern along a first axis. One row can operate in left-hand mode, and the other row can operate in right-hand mode. Each unit cell in the metamaterial array includes a volume of liquid crystal and at least one isolated ground patch. The isolated ground patch being is as a virtual ground connection capable of generating a potential difference for tuning the dielectric value of the liquid crystal. The first and second rows are oriented end-to-end along the first axis and separated from each other by a first distance. The antenna includes a phase variable liquid-crystal loaded lens that is controllable to be phase variable along a second axis orthogonal to the first axis.

18 Claims, 12 Drawing Sheets

(56) References Cited

U.S. PATENT DOCUMENTS

| | | | |
|---|---|---|---|
| 2009/0219213 | A1 | 9/2009 | Lee et al. |
| 2009/0245146 | A1 | 10/2009 | Gummalla et al. |
| 2012/0001826 | A1 | 1/2012 | Achour et al. |
| 2017/0062943 | A1 | 3/2017 | Patron et al. |
| 2018/0040961 | A1 | 2/2018 | Oshima et al. |

OTHER PUBLICATIONS

Senglee Foo et al. Liquid-crystal-tunable metasurface antennas, 2017 11th European Conference on Antennas and Propagation (EUCAP), total 5 pages.

* cited by examiner

ELECTRONICALLY BEAM-STEERABLE, LOW-SIDELOBE COMPOSITE RIGHT-LEFT-HANDED (CRLH) METAMATERIAL ARRAY ANTENNA

FIELD

The present disclosure relates to array antennas. More specifically, the present disclosure relates to array antennas incorporating composite right-left-handed (CRLH) metamaterials.

BACKGROUND

Leaky-wave antennas, which consist of a waveguide structure that allows low-level continuous Radio Frequency (RF) radiation along the length of the guiding structure, are used in a number of applications including communications applications such as 5G networks and satellite communication. To ensure radiation is directed in a fixed direction, typical leaky-wave antennas require that, at a given frequency, the propagation constant of a radiated field along the structure be kept constant. As a result, typical leaky-wave antennas have uniform aperture geometries. This configuration results in a natural exponential decay in amplitude from the feed point along the aperture of the antenna. The asymmetrical amplitude tapering field typically results in poor sidelobe performance in the radiation patterns for such antennas. Further, a typical leaky-wave antenna permits angular scan in fixed frequency only, and can only scan in approximately half of the available space (e.g., <90 degrees) due to the inherent positive propagation constant of the antenna.

Metamaterials (MTM) are artificial structures that behave differently from natural right-hand materials alone. A metamaterial may be made to operate in either or both left-handed and right-handed mode. Such materials are referred to as composite right-left-handed (CRLH) metamaterials. CRLH metamaterials can be engineered using conventional dielectric and conductive materials to produce unique electromagnetic properties.

CRLH metamaterial components may be fabricated on various substrates or circuit platforms such as conventional Printed Circuit Boards (PCBs) or flexible PCBs, providing an easily manufactured, inexpensive solution. The substrate may include a ground plane or a surface having a truncated or patterned ground portion or portions. Metamaterials including CRLH metamaterials can be used to construct antennas including leaky-wave antennas that avoid many of the drawbacks of conventional antennas including poor sidelobe performance and beams that are not electronically beam steerable.

SUMMARY

The present disclosure describes a practically realizable uniform leaky-wave antenna device. More specifically, in various examples, the present disclosure describes a two-dimensional (2D) electronically steerable millimeter-wave leaky-wave antenna that incorporates a plurality of liquid-crystal loaded CRLH metamaterials and which is capable of full-space beam steering over multiple frequencies and at a fixed frequency. By taking advantage of the right and left-handed properties of the CRLH metamaterial array, the antenna in various examples of the present disclosure can scan over the entire space (+/−90 degrees) and produce an aperture field that results in radiation patterns with relatively low sidelobes without requiring a non-uniform leaky-wave antenna structure.

In some aspects the present disclosure describes an antenna including a first substrate, a second substrate, and a composite right- and left-handed (CRLH) metamaterial array disposed between the first and second substrates. The metamaterial array includes at least one pair of first and second rows of unit cells. One of the first and second rows of unit cells is controllable to operate in left-hand mode, and the other of the first and second rows of unit cells is controllable to operate in right-hand mode. The at least one pair is configured to propagate a radiation pattern along a first axis. Each unit cell includes a volume of liquid crystal with a controllable dielectric value and at least one isolated ground patch electrically isolated from the first and second substrates. The at least one isolated ground patch is configured as a virtual ground connection capable of generating a potential difference for tuning the dielectric value of the volume of liquid crystal. The first and second row of unit cells is oriented end-to-end along the first axis and separated from each other by a first distance. The antenna also includes a phase variable liquid-crystal loaded lens provided on the CRLH metamaterial array. The lens is controllable to be phase variable along at least a second axis orthogonal to the first axis.

In any of the preceding aspects/embodiments, the first or second substrate may include a ground plane of the antenna, the at least one isolated ground patch being electrically isolated from the ground plane.

In any of the preceding aspects/embodiments, the CRLH metamaterial array may include a first pair and a second pair of first and second rows of unit cells, the second pair of rows of unit cells being parallel to the first pair of rows of unit of cells, the first and second pair of rows of unit cells being separated by a second distance along the second axis.

In any of the preceding aspects/embodiments, the second distance between the first and second pair of unit cells may be one quarter of an operating wavelength of the antenna.

In any of the preceding aspects/embodiments, the first distance between the first and second rows of unit cells of the at least one pair of unit cells may be one quarter of an operating wavelength of the antenna.

In any of the preceding aspects/embodiments, the lens may be phase variable only along the second axis.

In any of the preceding aspects/embodiments, the lens may be phase variable along the first axis and is also phase variable along the second axis.

In any of the preceding aspects/embodiments, the first substrate may include a copper layer.

In some aspects, the present disclosure describes a composite right- and left-handed (CRLH) metamaterial unit cell. The unit cell includes a first substrate and a second substrate, and an intermediate region defined between the first and second substrates. The unit cell also includes series capacitors for electrically coupling the unit cell to one or more adjacent unit cells, and parallel inductors for electrically coupling the unit cell to ground. The series capacitors and parallel inductors together form a composite right- and left-hand metamaterial structure. The unit cell also includes a volume of liquid crystal located in a cavity disposed within the intermediate region. The unit cell also includes at least one electrically isolated ground patch. The at least one isolated ground patch is electrically isolated from ground and configured as a virtual ground connection capable of generating a potential difference in the volume of liquid crystal.

In any of the preceding aspects/embodiments, the series capacitor may be one of a planar capacitor, a circular capacitor, an interdigital capacitor, or a series-oriented parallel plate capacitor.

In any of the preceding aspects/embodiments, the parallel inductor may have two open ends in two terminals of the inductor.

In some aspects, the present disclosure describes a wireless communication device. The wireless communication device includes an antenna for receiving and transmitting wireless signals. The antenna includes a first substrate, a second substrate, and a composite right- and left-handed (CRLH) metamaterial array disposed between the first and second substrates. The metamaterial array includes at least one pair of first and second rows of unit cells. One of the first and second rows of unit cells is controllable to operate in a left-hand mode, and the other of the first and second rows of unit cells is controllable to operate in right-hand mode. The at least one pair is configured to propagate a radiation pattern along a first axis. Each unit cell includes a volume of liquid crystal with a controllable dielectric value and at least one isolated ground patch electrically isolated from the first and second substrates. The at least one isolated ground patch is configured as a virtual ground connection capable of generating a potential difference for tuning the dielectric value of the volume of liquid crystal. The first and second row of unit cells is oriented end-to-end along the first axis and separated from each other by a first distance. The antenna also includes a phase variable liquid-crystal loaded lens provided on the CRLH metamaterial array. The lens is controllable to be phase variable along at least a second axis orthogonal to the first axis. The wireless communication device also includes a processing device for providing control signals to the antenna. The control signals enable tuning of the volume of liquid crystal, to control direction of a beam of the antenna along the first axis. The control signals also enable control of the lens, to control direction of the beam along the second axis.

In any of the preceding aspects/embodiments, in the antenna, the first or second substrate may include a ground plane of the antenna, the at least one isolated ground patch being electrically isolated from the ground plane.

In any of the preceding aspects/embodiments, in the antenna, the CRLH metamaterial array may include a first pair and a second pair of first and second rows of unit cells, the second pair of rows of unit cells being parallel to the first pair of rows of unit of cells, the first and second pair of rows of unit cells being separated by a second distance along the second axis.

In any of the preceding aspects/embodiments, in the antenna, the second distance between the first and second pair of unit cells may be one quarter of an operating wavelength of the antenna.

In any of the preceding aspects/embodiments, in the antenna, the first distance between the first and second rows of unit cells of the at least one pair of unit cells may be one quarter of an operating wavelength of the antenna.

In any of the preceding aspects/embodiments, in the antenna, the lens may be phase variable only along the second axis.

In any of the preceding aspects/embodiments, in the antenna, the lens may be phase variable along the first axis and is also phase variable along the second axis.

Directional references herein such as "front", "rear", "up", "down", "horizontal", "top", "bottom", "side" and the like are used purely for convenience of description and do not limit the scope of the present disclosure. Furthermore, any dimensions provided herein are presented merely by way of an example and unless otherwise specified do not limit the scope of the disclosure. Furthermore, geometric terms such as "straight", "flat", "curved", "point" and the like are not intended to limit the disclosure any specific level of geometric precision, but should instead be understood in the context of the disclosure, taking into account normal manufacturing tolerances, as well as functional requirements as understood by a person skilled in the art.

BRIEF DESCRIPTION OF THE DRAWINGS

Reference will now be made, by way of example, to the accompanying drawings which show embodiments of the present application, and in which.

Similar reference numerals may have been used in different figures to denote similar components.

DETAILED DESCRIPTION OF EMBODIMENTS

In at least some examples, the disclosed array antenna (also referred to simply as an antenna) includes a bidirectional composite right-left-handed (CRLH) metamaterial (MTM) array (also referred to simply as a metamaterial array) that includes at least one pair of first and second rows of unit cells. The metamaterial array is capable of supporting radio frequency (RF) transmission both in left-hand and right-hand wave propagation. The metamaterial array includes a liquid crystal (LC) loaded transmission line structure based on a modification to a grounded coplanar waveguide (GCPW), with a thin layer of additional substrate material over at least one surface. The volume of liquid crystal is encapsulated using first and second substrates of the antenna. The liquid crystal in the CRLH metamaterial array allows beam scanning over multiple frequencies or at a fixed frequency, over the full angular range including the broadside angle (i.e., zero degrees). In some examples, this can result in reduced beam degradation.

In at least some examples, a one-dimensional (1D) or two-dimensional (2D) liquid crystal-loaded metamaterial lens is provided over the CRLH metamaterial array to allow beam scanning in a second orthogonal direction, thus enabling beam steering in two dimensions. The liquid-crystal-loaded metamaterial lens can allow a transmission phase of each pair of rows of unit cells to be independently electronically tuned. The unit cells of the metamaterial array can be fed in groups to allow flexible hybrid beam forming for multiple beams, or can be fed with coherent phase to form a directional steerable beam.

As a result of the beam steerable capability of the LC-loaded CRLH metamaterial array and LC-loaded MTM lens, examples of the disclosed antenna may be able to produce a steerable beam having relatively low sidelobe, and relatively high gain. The beam may be steerable in a 2D plane parallel to the lens aperture. Examples of the disclosed antenna may be suitable for various wireless communications applications, such as 5G networks and satellite communications.

Figure 1:
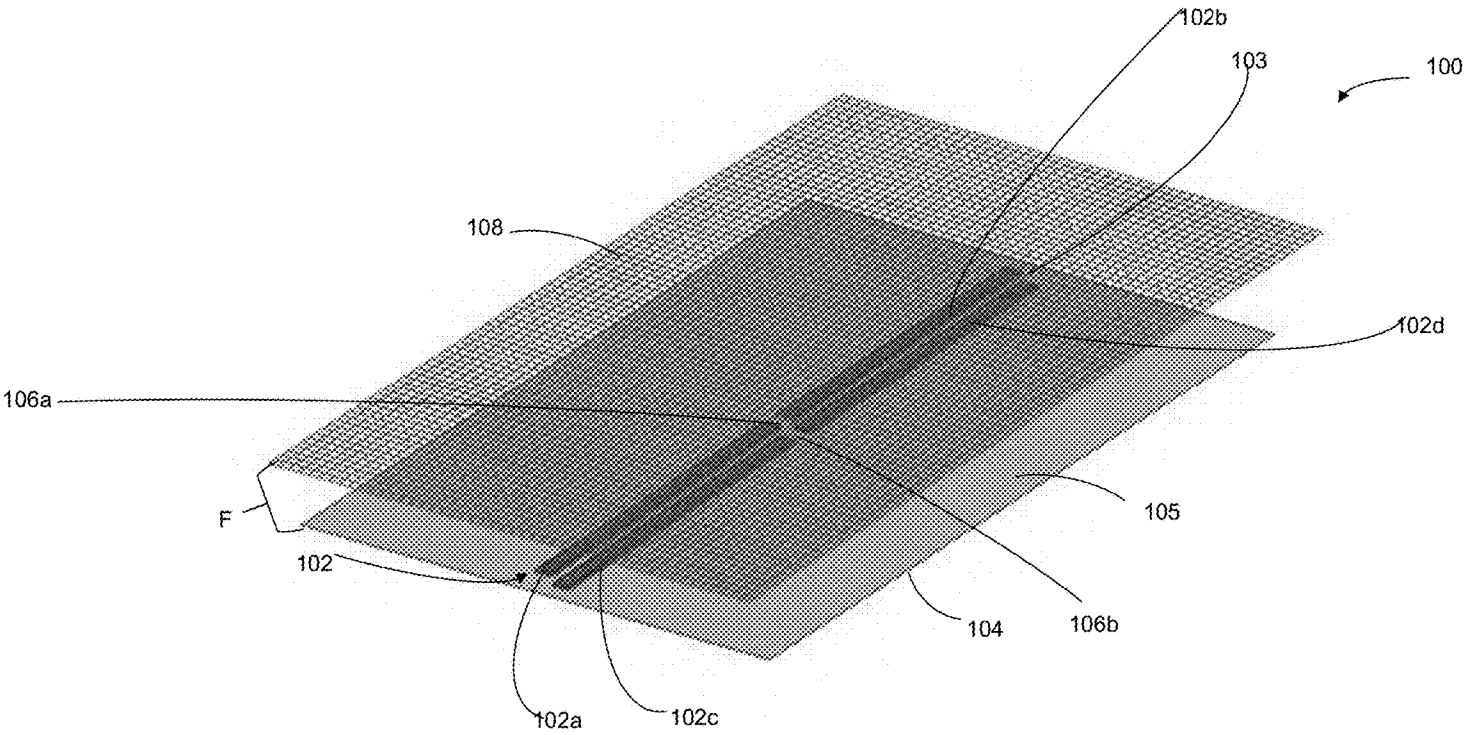
FIG. 1 is a perspective view of an example array antenna according to the present disclosure.

Referring to the Figures, FIG. 1 illustrates an antenna 100 that includes at least a first substrate 104 and a second substrate 105. In the example of FIG. 1, the first substrate 104 may be the bottom substrate and the second substrate 105 may be the top substrate. The antenna 100 may include conductive material printed onto the first substrate 104. The first substrate 104 may act as a ground plane of the antenna 100 and may include a dielectric material that can electrically isolate a surface of the substrate 104 from another surface. A surface of the first substrate 104 may be a layer included in a multilayer structure such as at least a portion of a printed circuit board (PCB) or application board in a wireless-capable device.

The antenna 100 includes a CRLH metamaterial array 102 that can be provided on a surface of a first substrate 104 and a phase variable liquid-crystal loaded lens 108. The lens 108 may enable control of the antenna beam in one dimension, or in two dimensions.

In some embodiments, the antenna 100 includes the first substrate 104, the second substrate 105, and a CRLH metamaterial array 102 disposed between the first and second substrates 104, 105. The CRLH metamaterial array 102 includes at least one pair of first and second rows 102*a*, 102*b* of unit cells 110 (see FIG. 3). Each unit cell 110 includes a volume of liquid crystal 124 (see FIGS. 4 and 5) with a controllable dielectric value and one or more electrically isolated ground patches. The isolated ground patches are configured as one or more virtual ground connections capable of generating a potential difference in the volume of liquid crystal 124.

The first and second rows 102*a*, 102*b* of unit cells each have a propagation direction along a first axis (which may be a longitudinal or transverse axis) of the first substrate 104, and are oriented end-to-end and separated by a distance 106*a* along the first axis of the first substrate 104. Generally, the CRLH metamaterial array 102 includes first and second rows 102*a*, 102*b* that operate in opposite propagation direction and are fed in opposite phases. Each row of unit cells (e.g. 102*a*, 102*b*) is capable of operating in either left-hand or right-hand mode. However, in at least some embodiments, the first and second rows of unit cells (e.g. 102*a*, 102*b*) may be controlled such that one row of the pair of unit cells (e.g. 102*a*) operates substantially in left-hand mode and the other row of unit cells (e.g. 102*b*) operates substantially in the right-hand mode.

In operation, at frequencies below a transition frequency of antenna 100, a row of unit cells (e.g. 102*a*, 102*b*) operates in left-hand mode. At frequencies above the transition frequency, the same row of unit cells (e.g. 102*a*, 102*b*) operates in right-hand mode. Thus, the first and second rows 102*a*, 102*b* of the metamaterial array 102 operate in opposite propagation directions as one of the rows of unit cells (e.g. 102*a*) is configured to operate in left-hand mode by operating the row of unit cells 102*a* at a frequency below the transitional frequency. The other row of unit cells (e.g. 102*b*) is configured to operate in right-hand mode by operating the row of unit cells 102*b* at a frequency above the transitional frequency. In some examples, one row of unit cells (e.g., 102*a*) may be configured to operate mostly in the left-hand mode, and the other row of unit cells (e.g., 102*b*) may be configured to operate mostly in the right-hand mode. Such tuning of left-hand or right-hand mode operation may be made by implementing suitable variations in the physical parameters when manufacturing the respective rows 102*a*, 102*b*.

In some embodiments, the first and second rows of unit cells 102*a*, 102*b* are separated by a distance 106*a* that is about a quarter of the operational wavelength λ of the antenna 100.

In the embodiment shown in FIG. 1, the metamaterial array 102 also includes a second pair of first and second rows 102*c*, 102*d* of unit cells. The second pair of rows 102*c*, 102*d* are arranged parallel to the first pair of rows 102*a*, 102*b* (i.e., parallel to the longitudinal axis of the metamaterial array 102. The two pairs of rows 102*a*, 102*b*; 102*c*, 102*d* are staggered and offset side-by side by a distance 103 along a transverse axis of the metamaterial array 102. The distance 103 may be a quarter of the operational wavelength A.

As mentioned above, the antenna 100 includes a liquid crystal loaded metamaterial lens 108. The lens 108 is configured to be phase variable in one or two dimensions. In some embodiments, the lens 108 is phase variable only along the longitudinal axis of the metamaterial array 102 (in which case the lens 108 may be referred to as a one-dimensional or 1D lens). In other embodiments, the lens 108 may be phase variable along the longitudinal axis of the metamaterial array 102 and also along a transverse axis of the metamaterial array 102 (in which case the lens 108 may be referred to as a two-dimensional or 2D lens). In some embodiments, the diameter of the lens 108 is approximately 100 mm. The lens 108 may be positioned a distance F above the metamaterial array 102. The distance F may be selected in order to achieve a desired value of F/D, where D is the diameter of the lens. In at least some embodiments, an F/D value of approximately 0.25 may be desired. In such cases, when the diameter of the lens 108 is about 100 mm, the distance F above the metamaterial array 102 is selected to be approximately 25 mm.

In at least some embodiments, a 1D lens, as described herein, may be used. A 1D lens may require fewer direct control lines compared to a 2D lens. A 2D lens may also have a limited aperture lens dimension due to DC control restriction, whereas in a 1D lens the aperture dimension in the beam steerable direction may not be restricted since DC control may be only required in one direction. This may help to eliminate or reduce distortion in beam patterns due to the presence of metallic DC walls. Such distortion may otherwise result in a limited angular scan range. Due to the complexity of wiring and connections of DC control signals, it is typically not practical to avoid the presence of metallic walls and maintain a low profile with 2D scanning using LC-loaded lens. A 2D lens may also be more complicated to control compared to a 1D lens, as a 1D lens may be easier to feed with a DC control signal.

Figure 2:
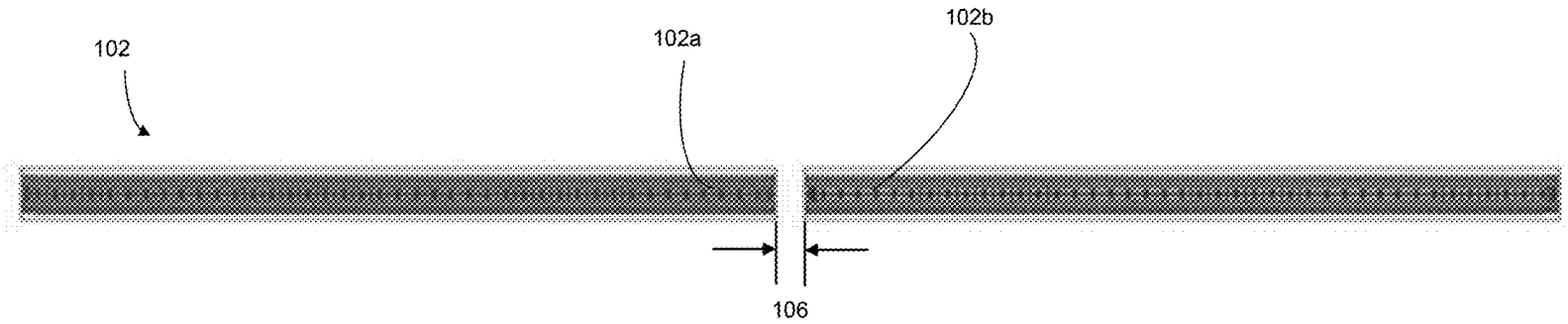
FIG. 2 is a top planar view of an example CRLH metamaterial array according to the present disclosure.
Figure 11:
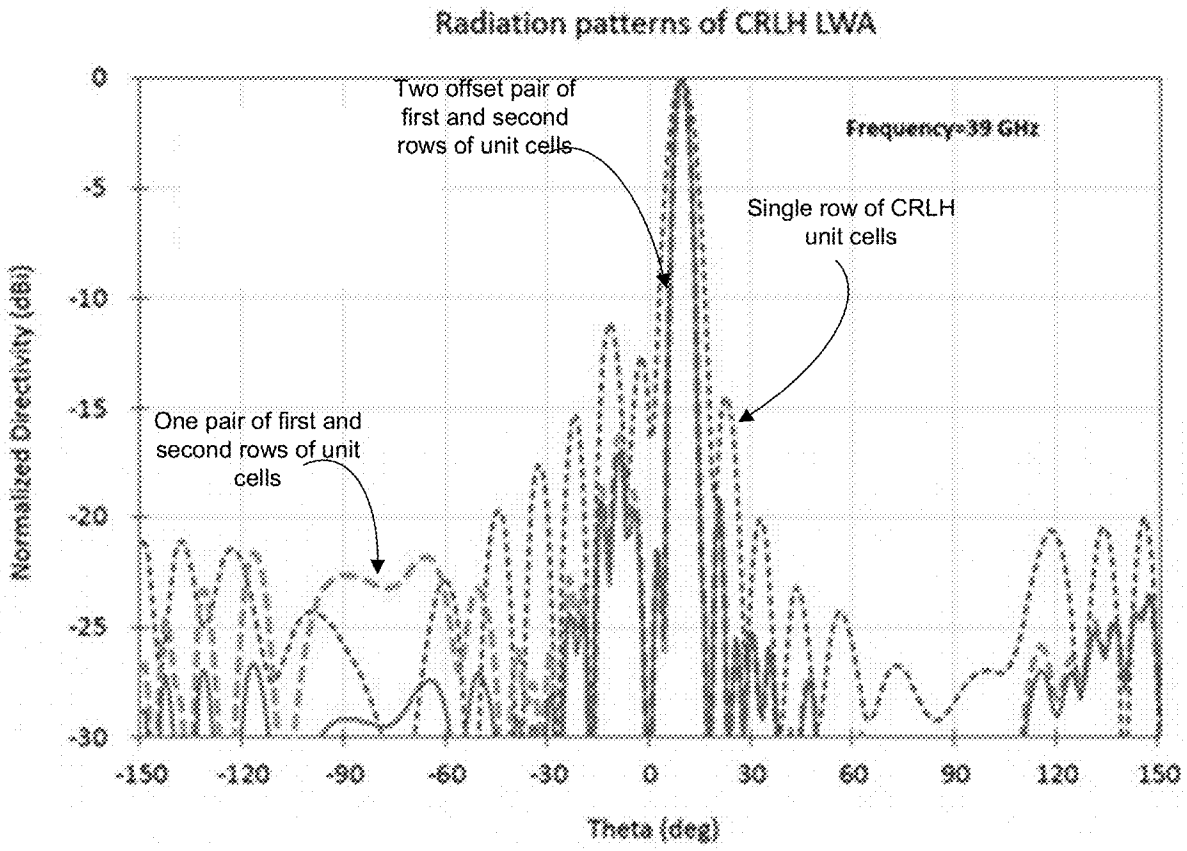
FIG. 11 is a plot comparing radiation patterns for a single row of unit cells, a pair of first and second rows of unit cells operating in left-hand and right-hand modes, and two pairs of first and second rows of unit cells operating in right-hand and left-hand modes.

FIG. 2 shows an example configuration of a CRLH metamaterial array 102. In this embodiment, the CRLH metamaterial array 102 includes only one pair of first and second rows 102*a*, 102*b* of unit cells oriented with opposite propagation direction and fed to operate in opposite modes (i.e., one operating in left-hand transmission mode and the other operating in right-hand transmission mode) along the longitudinal axis of the CRLH metamaterial array 102. In at least some embodiments, when the rows 102*a*, 102*b* are fed in opposite phase and separated by a distance 106 of approximately one quarter wavelength λ apart, steering over an angular range from +90 degrees to −90 degrees is possible. A high-gain, low-sidelobe radiation pattern can be produced (as seen in FIG. 11). The sidelobe performance can be further improved by staggering another pair of rows (e.g., rows 102*c*, 102*d* shown in FIG. 1) of unit cells alongside the first pair of rows 102*a*, 102*b* and separating the two pairs of rows by the offset distance 103. The offset distance 103 may be substantially equal to the separation distance 106 (e.g., approximately a quarter of the operating wavelength A).

Figure 3:
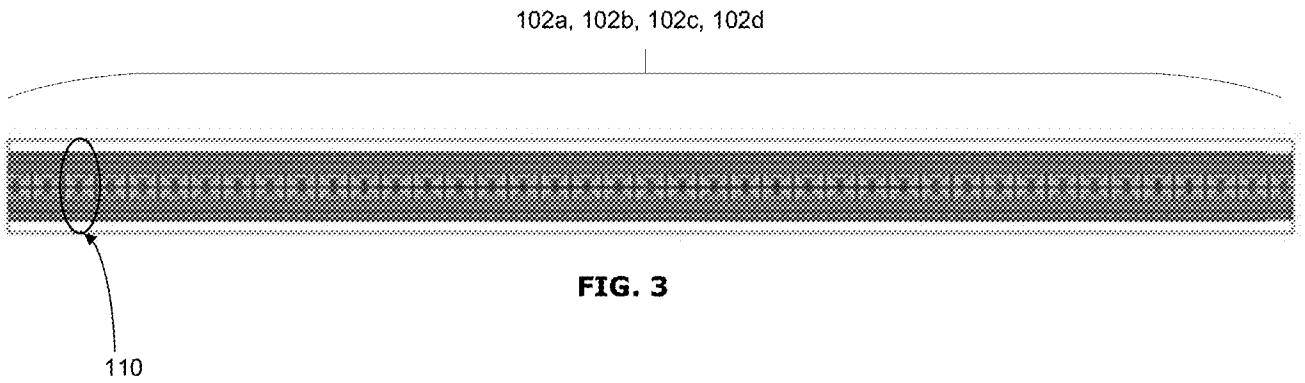
FIG. 3 is a top view of a portion of the CRLH metamaterial array of FIG. 2.

Reference is now made to FIG. 3, which shows a representative segment of one row 102*a*, 102*b*, 102*c*, 102*d* of unit cells. Each row 102*a*, 102*b*, 102*c*, 102*d* of unit cells is made of one or more liquid crystal loaded CRLH unit cells 110 that repeat to form the metamaterial transmission line structure of the one row of unit cells. A longer row of unit cells 110 may provide a higher gain of the antenna 100.

Figure 4:
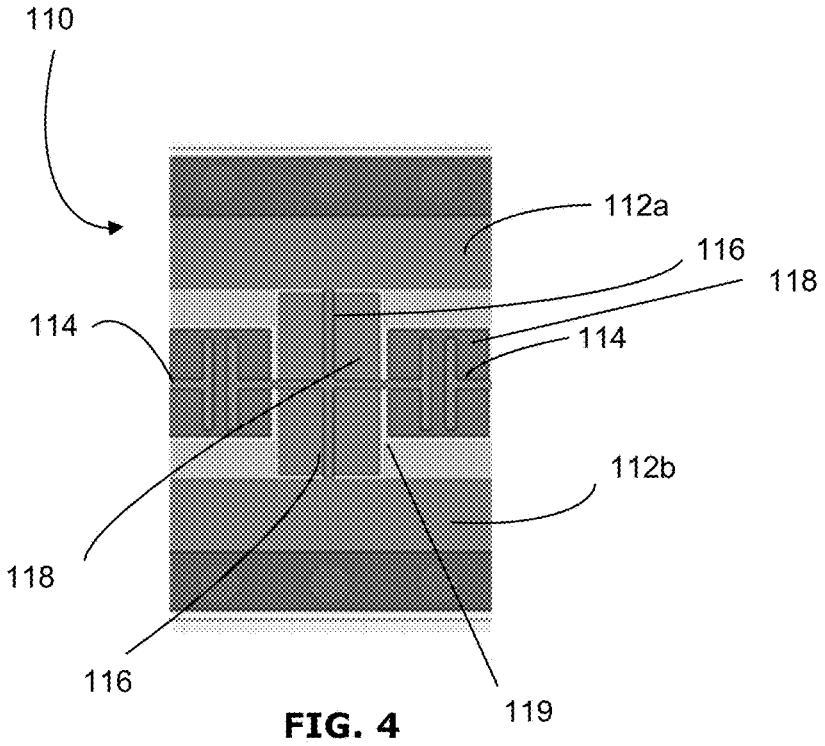
FIG. 4 is a top view of an example unit cell of a CRLH metamaterial array according to the present disclosure.
Figure 5:
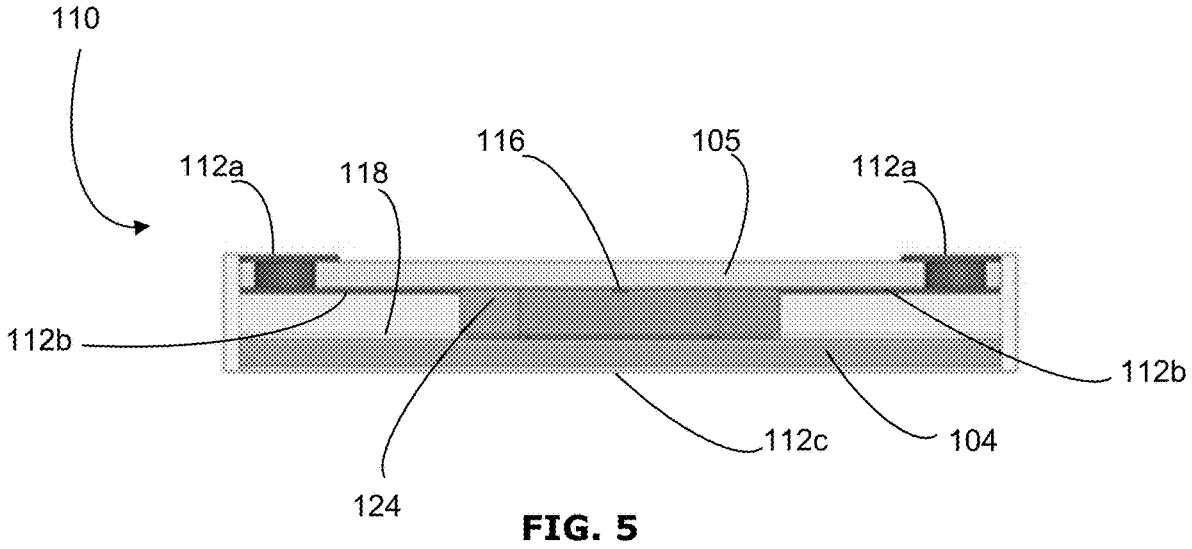
FIG. 5 is a side cross sectional view of the unit cell of FIG. 4.

An example unit cell 110 is shown in FIGS. 4 and 5. FIG. 4 shows a top-down view of the unit cell 110, and FIG. 5 shows a side cross-sectional view of the unit cell 110. The unit cell 110 includes portions of the first and second substrates 104, 105. In some embodiments, the first and second substrates 104, 105 are provided by a portion of a PCB or application board. In some embodiments, the first and second substrates 104, 105 are double sided PCBs. A volume of liquid crystal 124 is embedded in a cavity between the first and second substrates 104, 105. The liquid crystal 124 is thus encapsulated between the first and second substrates 104, 105. Encapsulation of the liquid crystal 124 within the unit cells 110 of the metamaterial array 102 may enable positive and negative electronic beam scanning, including scanning of the broadside angle (zero degrees). The other components of the unit cell 110 can be glued together and then positioned within first and second substrates 104, 105. Thus the unit cell 110 can be more easily manufactured using a scalable process, for example without requiring manual construction. In some embodiments (for example uniform leaky wave antennas), each of the unit cells 110 of the metamaterial array 102 have identical geometry and configurations. However, in at least some embodiments (for example non-uniform leaky wave antennas), one or more unit cells 110 of the metamaterial array 102 may have different geometries and configurations with different capacitors, inductors and/or positions of the virtual grounds. In some embodiments, the lengths of the pairs of first and second rows that make up the metamaterial array 102 are substantially equal (i.e. the lengths of rows 102*a* and 102*b* are substantially equal and the lengths of rows 102*c* and 102*d* are substantially equal).

The first and second substrates 104, 105 of the unit cell 110 are oriented in spaced opposition to each other and may align with each other to form a region which contains a volume of liquid crystal 124. In an example embodiment, first and second substrates 104, 105 and the volume of liquid crystal 124 can be relatively thin, which may help to improve liquid crystal response to an electrostatic field that may be applied to tune the liquid crystal 124.

In some embodiments, the volume of liquid crystal 124 can be a nematic liquid crystal or any other suitable liquid crystal. Where the liquid crystal 124 is a nematic liquid crystal, the nematic liquid crystal may have an intermediate nematic gel-like state between solid crystalline and liquid phase at the intended operating temperature range of the antenna 100. Examples of suitable liquid crystals include, for example, GT3-23001 liquid crystal or BL038 liquid crystal from the Merck group. Liquid crystal 124 may possess dielectric anisotropy characteristics at microwave frequencies and the effective dielectric constant may be adjusted by setting different orientations of the molecules of liquid crystal 124 relative to its reference axis.

At microwave frequencies, the liquid crystal 124 may change its dielectric properties due to different orientations of the molecules caused by application of electrostatic field between the first and second substrates 104, 105. Thus, the effective dielectric constant can be tuned by varying the DC voltage applied to each unit cell 110, allowing the transmission phase of the unit cells 110 to be controlled.

The unit 110 cell includes one or more ground planes 112*a*, 112*b*, 112*c* which may be provided on one or both sides of one or both of the first and second substrates 104, 105. The unit cell 110 includes two series capacitors 114 and two parallel inductors 116. The unit cell 110 also includes one or more isolated patches configured as virtual grounds 118 of the unit cell 110. The virtual ground(s) 118 are located on one side (e.g. the top side) of the first substrate 104. The virtual ground(s) 118 are electrically isolated from DC by one or more slots 119. The planar series capacitor 114 and parallel inductor 116 are arranged similar to a grounded coplanar waveguide (GCPW) configuration. As shown in FIG. 4, the unit cell 110 includes the series capacitors 114 providing electrical coupling in series between adjacent unit cells 110. The unit cell 110 also includes the parallel inductors 116 provide parallel electrical coupling to ground.

In the embodiment shown in FIGS. 4 and 5, the parallel inductors 116 and planar capacitors 114 are DC grounded via a DC ground plane of the unit cell 110, which may be one or more of the ground planes 112*a*, 112*b*, 112*c*. Thus, isolated patches of the virtual ground 118 provide a means of introducing a DC bias voltage to tune the liquid crystal 124. To introduce a potential difference in the volume of liquid crystal 124 between the first substrate 104 and the second substrate 105, the virtual ground planes 118 may be provided on one side (e.g. the top side) of the first substrate 104 and positioned directly under the series capacitor 114 and the parallel inductors 116, as shown in FIG. 5. The isolated patches of the virtual ground 118 can be used as a substitute for an open microstrip transmission structure. Conventional microstrip transmission structures tend to require additional layers of substrate material. At higher operating frequencies, such as millimeter wave frequencies (e.g., as proposed for 5G communications), the additional substrate material can result in spurious transmission modes.

Figure 6:
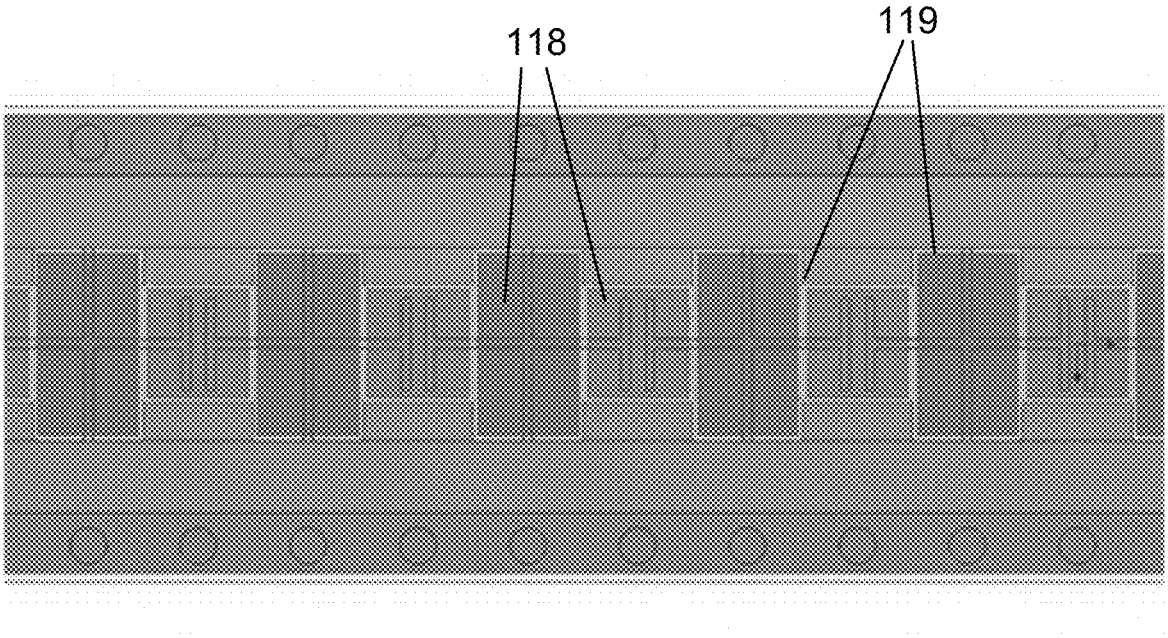
FIG. 6 is a top view of a segment of the CRLH metamaterial array of FIG. 2 showing the virtual ground structure of the unit cell of FIG. 4.

FIG. 6 shows a portion of the CRLH metamaterial array 102, with a clearer view of the position of the virtual ground 118 and virtual ground slots 119. The configuration of the virtual ground 118 enables control of static field strength in the volume of liquid crystal 124, by enabling appropriate control voltages to be applied for electrically tuning the volume of liquid crystal 124. The isolated patches of virtual ground 118 act as a virtual RF ground and permit changes of electrostatic field in the volume of liquid crystal 124 for beam steering. In operation, the virtual grounds 118 isolate the path of the DC current while allowing RF signals to propagate. Each isolated patch of virtual ground may 118 operate as an isolated ground at low frequencies while operating as a relatively continuous ground at high frequencies. Incorporation of the virtual grounds 118 in the unit cells 110 of the metamaterial array 102 and the GCPW configuration of the unit cell 110 may thus enable the introduction of DC voltages in the volume of liquid crystal 124 for beam scanning.

Figure 7:
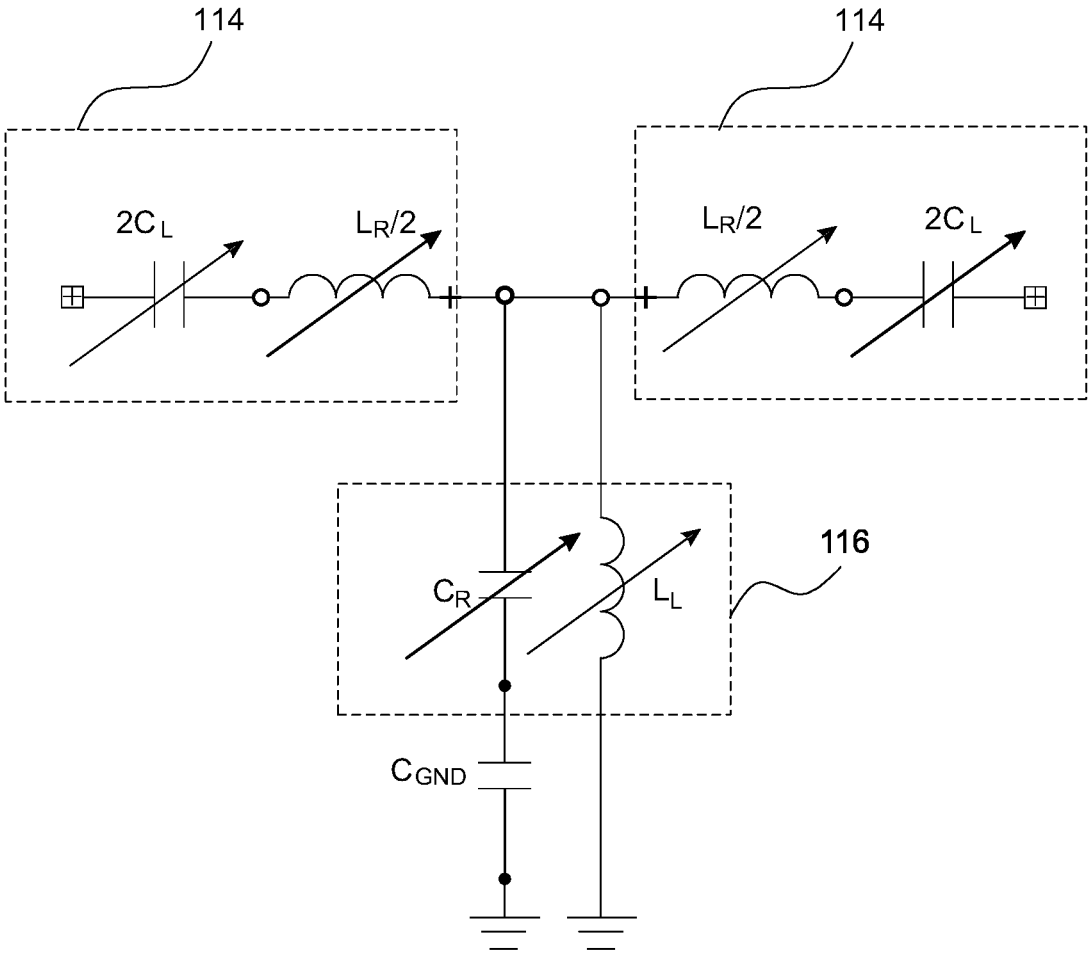
FIG. 7 is an equivalent circuit representation of the unit cell of FIG. 4.

Reference is made to FIG. 7, which shows an equivalent circuit of the example CRLH metamaterial array unit cell 110 of FIG. 4. In this example, the unit cell 110 includes series capacitors 114 and parallel inductors 116 with finite length transmission lines. With the inherent right-hand circuit parameters in the finite transmission line length, the unit cell 110 can be characterized by four circuit parameters, namely right-hand capacitance $C_R$, left-hand capacitance $C_L$, right-hand inductance $L_R$ and left-hand inductance $L_L$.

Dimensions of the capacitors 114 and the inductors 116 may be selected using simulation software (e.g., using iterative calculations) such as High Frequency Structure Simulator (HFSS) to generate the desired right-hand and left-hand capacitances and inductances ($C_L$, $C_R$, $L_L$, $L_R$). In example simulations, the transition frequency of the unit cell can be calculated using the following example equation:

$$\omega_o = \sqrt{\omega_R \omega_L}\text{; where } \omega_R = \frac{1}{\sqrt{L_R C_R}},\ \omega_L = \frac{1}{\sqrt{L_L C_L}}$$

Further, in example simulations where the antenna 100 is operating in balanced mode (i.e., when the series resonant frequency $\omega_{se}$ is approximately equal to the shunt resonance frequency $\omega_{sh}$), the series and shunt resonance frequencies, respectively, can be calculated as follows:

Series resonance frequency $$\omega_{se} = \frac{1}{\sqrt{L_R C_L}}$$

Shunt resonance frequency $$\omega_{sh} = \frac{1}{\sqrt{L_L C_R}}$$

The above parameters are variable depending on the geometries of the structure and effective dielectric constant ($E_R$) of the liquid crystal 124 embedded between the first and second substrates 104, 105 which can be tuned as described herein.

When antenna 100 is in operation, the liquid crystal 124 may be controlled such that the antenna 100 is operating in the maximum scan angle when the effective dielectric constant is set at the lowest value (e.g., 2.5). The antenna 100 may be controlled so that the radiation beam is slowly scanned from the initial angle through the broadside angle (i.e., 0 degrees) to the opposite angular space as the dielectric constant increases (e.g., from 2.5 to 3.3).

Referring to FIGS. 8A to 8D, the unit cell 110 of the CRLH metamaterial array 102 can also be implemented using various series capacitors and inductors with different geometries.

Figure 8A:
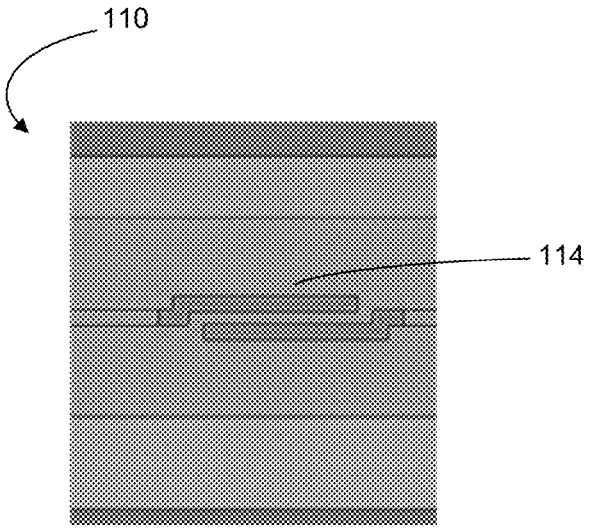
FIGS. 8A to 8C show example configurations of series capacitors for a unit cell of a CRLH metamaterial array according to the present disclosure.
Figure 8B:
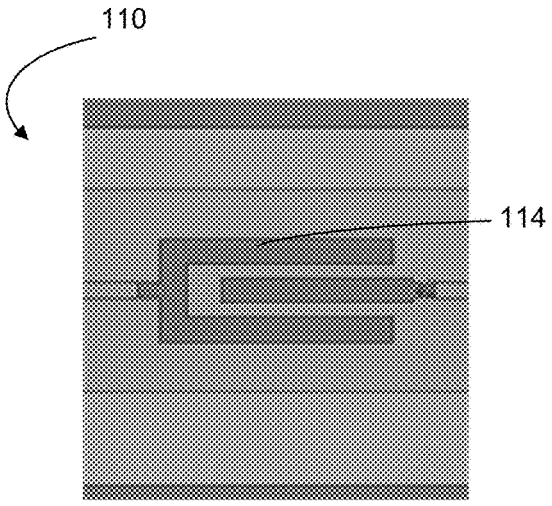
Figure 8C:
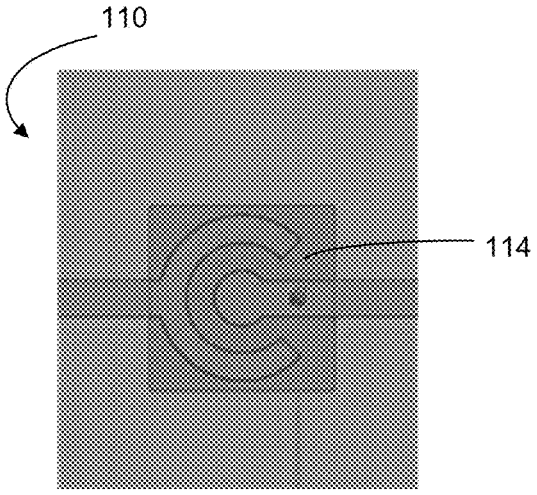

FIGS. 8A to 8C show configurations of example series capacitors that can be used as part of unit cell 110 in place of the series capacitor 114 configuration shown in FIG. 4. The different example configurations of the series capacitors may provide substantially similar performance at various frequencies. Possible variations of the planar series capacitor include series orientation parallel plate capacitors (FIG. 8A), interdigital finger series capacitor (FIG. 8B), or circularly shaped disk series capacitor (FIG. 8C). CRLH unit cells 110 with these configurations may provide series capacitor that are smaller in the transverse direction of the transmission line. This may be advantageous for CRLH metamaterial arrays in which a larger series capacitance is required in a more compact design. However, since these types of series capacitors have longer effective length in the propagation direction, they tend to have a higher right-hand parameters $C_R$ and $L_R$, which may limit overall frequency bandwidth of a leaky wave antenna.

Figure 8D:
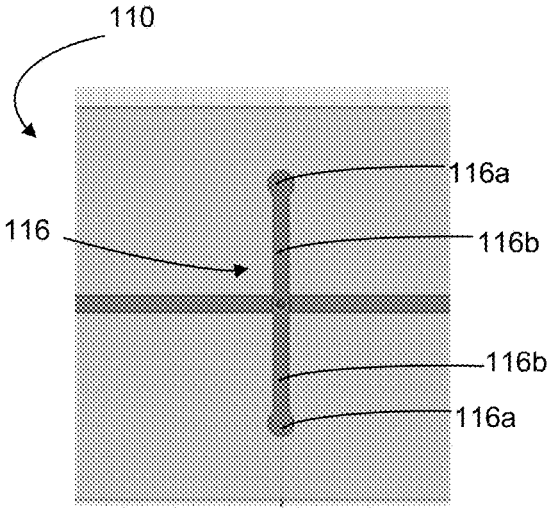
FIG. 8D shows an example configuration of a parallel inductor for a unit cell of a CRLH metamaterial array according to an embodiment of the present disclosure.

FIG. 8D shows an example configuration of a parallel inductor 116 that can be used as part of unit cell 110 in place of the parallel inductor 116 shown in FIG. 4. The different example configurations of the parallel inductors may provide substantially similar performance at various frequencies. As seen in FIG. 8D, the parallel inductor has two open ends 116*a* in the two terminals 116*b* of the inductor 116, instead of being grounded to the DC ground plane. This type of inductor configuration may result in higher right-hand capacitance and inductance. Consequently, this geometry may result in reduced frequency bandwidth and degraded antenna performances. However, in some cases, the inductor shown in FIG. 8D may be desirable. In the embodiments shown in FIGS. 8A to 8D, the unit cells 110 are configured such that while virtual grounds 118 can be present, the structure of capacitors 114 and inductors 116 is such that virtual grounds 118 may not be required to introduce a DC bias into the unit cell 110. In the embodiments shown in FIGS. 8A to 8D, copper pattern layers of inductors 114 and capacitor 116 are not DC grounded. As a result, they can be directly connected to a source of DC voltage to tune the volume of liquid crystal 124, thus obviating the need for a virtual ground. However, this may be at the expense of reducing the overall frequency bandwidth.

In general any combination of the inductors and capacitors shown in FIGS. 8A to 8D, or other suitable capacitor and inductor configurations, may be used as part of the unit cell 110.

Figure 9:
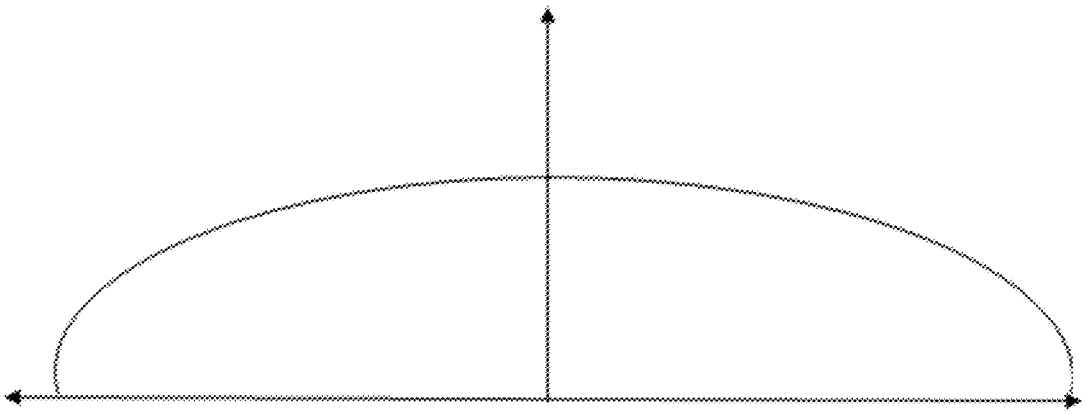
FIG. 9 is a representative plot showing amplitude tapering of an example CRLH metamaterial array of the present disclosure.

As described above, in at least some embodiments, the CRLH metamaterial array 102 may include only one pair of first and second rows 102*a*, 102*b* of unit cells. This embodiment can also demonstrate improved sidelobe performance. FIG. 9 shows a plot of amplitude tapering of an example CRLH metamaterial array 102 shown in FIG. 2 (i.e., having one pair of first and second rows 102*a*, 102*b* of unit cells). To obtain the amplitude tapering shown in FIG. 9, with symmetrical maximum in the middle of the CRLH metamaterial array 102, power is injected in the middle of the metamaterial array 102 between the first and second rows 102*a*, 102*b* of unit cells along their end-to-end orientation.

This configuration of the CRLH metamaterial array 102 may result in a radiation field that has a symmetrically decaying amplitude taper.

In operation, a first row of unit cells (e.g. 102*a*) operates in left-hand transmission mode and a second row of unit cells (e.g. 102*b*) operates in right-hand transmission mode. As a result of the opposite propagation direction of the respective unit cells, the CRLH metamaterial array 102 is therefore able to scan from positive angular space (right-hand mode) to negative angular space (left-hand mode).

Figure 10:
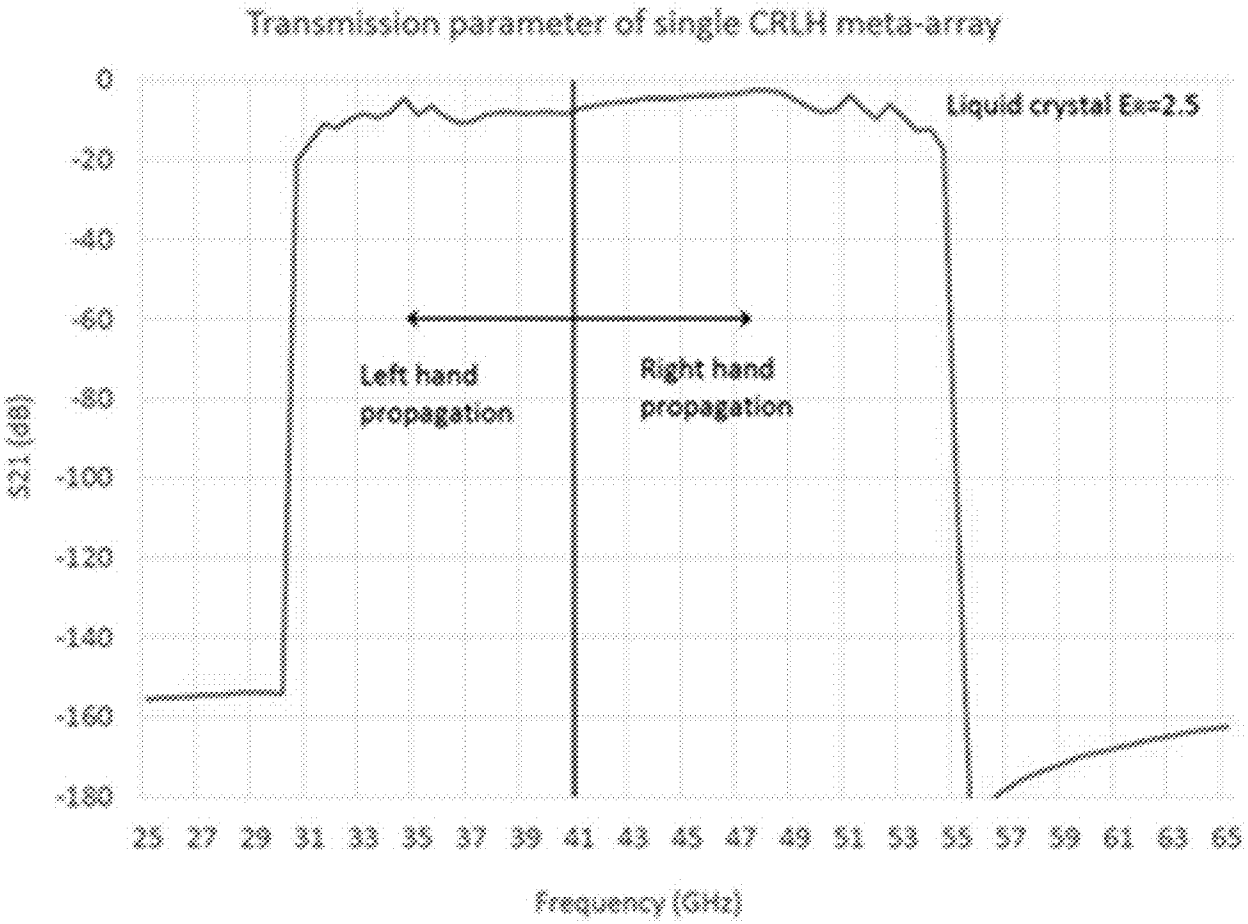
FIG. 10 is a plot showing transmission parameters, over a range of frequencies, of an example CRLH metamaterial array of the present disclosure.

FIG. 10 shows the S-21 transmission parameter of a CRLH metamaterial array 102 with one pair of first and second rows 102*a*, 102*b* of unit cells designed to have a transition frequency of 41 GHz. Below 41 GHz, the array 102 can operate in left-hand propagation mode. Above 41 GHz, the array 102 operates in right-hand propagation mode. In at least some embodiments, the CRLH metamaterial array 102 can operate between 30.5 GHz and 54.5 GHz, with a frequency bandwidth of over 55%.

FIG. 11 shows example radiation patterns to illustrate the performance of an example of the disclosed antenna 100 having a CRLH metamaterial array 102. For comparison, FIG. 11 shows the radiation pattern for a single row of unit cells. FIG. 11 also shows the radiation pattern for a CRLH metamaterial array 102 with one pair of rows 102*a*, 102*b* of unit cells fed in opposite phase and separated by a quarter wavelength A; and a CRLH metamaterial array 102 with two pairs of parallel rows 102*a*, 102*b*; 102*c*, 102*d* of unit cells, with each respective pair fed in opposite phase, the two pairs being staggered by a quarter wavelength λ and separated by a quarter wavelength A. As can be seen from FIG. 11, a CRLH metamaterial array 102 with a single pair of rows of unit cells 102*a*, 102*b*, spaced a quarter wavelength λ apart end-to-end, results in an improved radiation pattern and improved sidelobes as compared to only one row of unit cells. In some examples, adding a second pair of first and second rows 102*c*, 102*d* of unit cells can further improve sidelobe performance, particularly in the far end of the radiation patterns of antenna 100.

Figure 12:
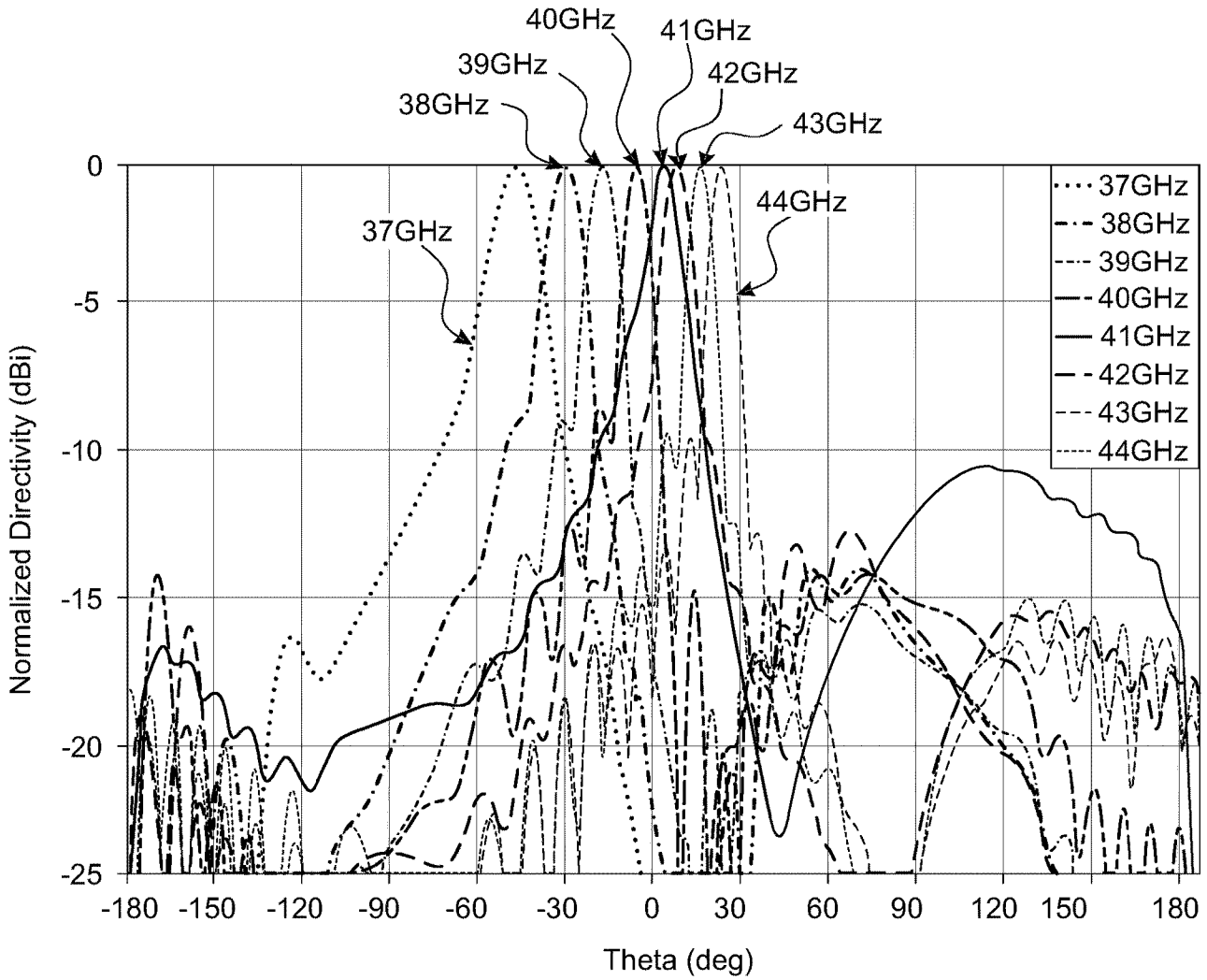
FIG. 12 is a plot showing frequency scan patterns of an example CRLH metamaterial array of the present disclosure over a frequency range of 37 GHz to 44 GHz.
Figure 13:
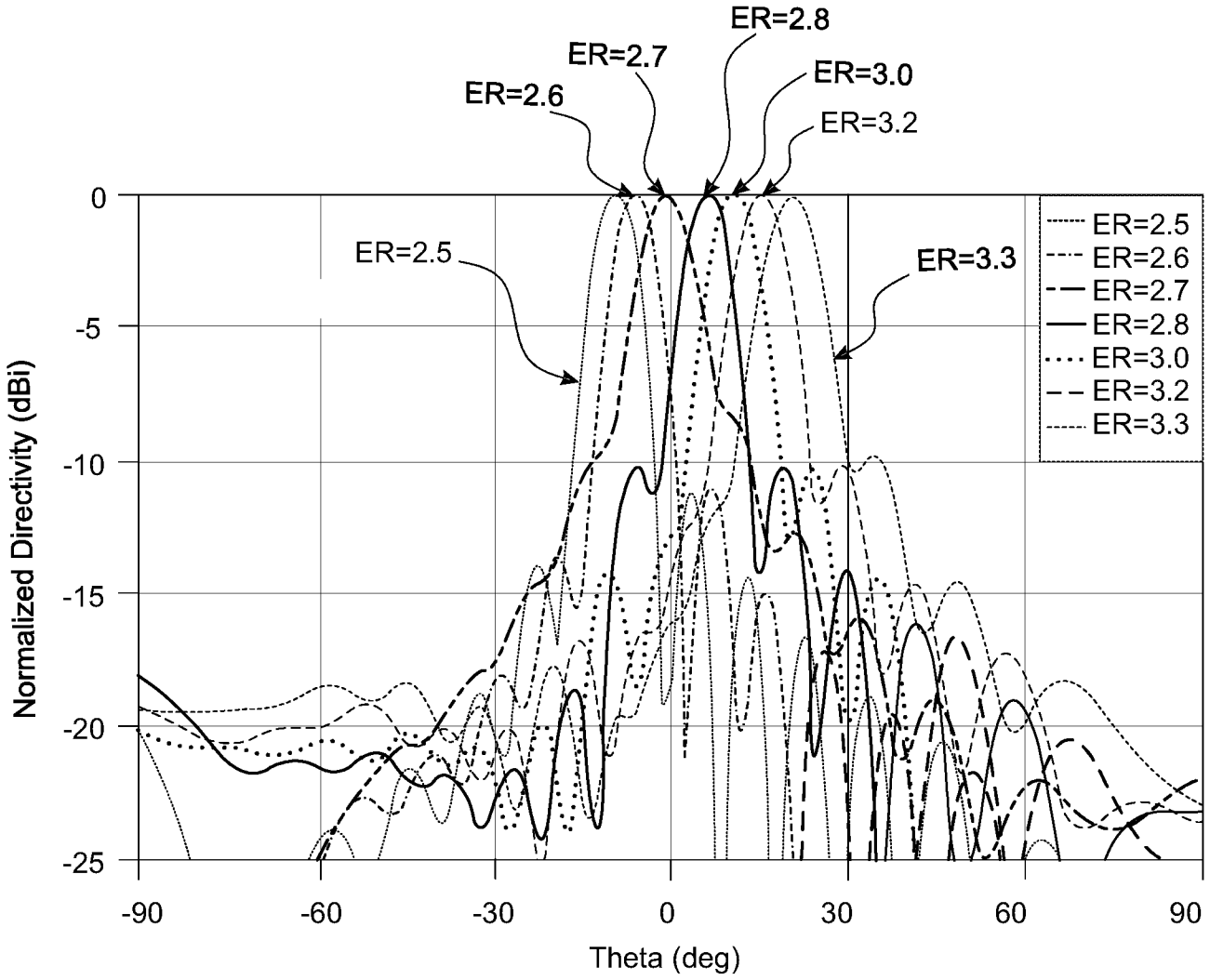
FIG. 13 is a plot showing beam scan patterns of an example CRLH metamaterial array at a fixed frequency over a range of dielectric constants.

FIG. 12 shows example radiation patterns of an example antenna 100 with a metamaterial array 102 with a single pair of rows 102*a*, 102*b* of unit cells over a range of frequencies and with the liquid crystal dielectric constant fixed at 2.5. FIG. 13 shows radiation patterns of a comparable antenna 100 at a fixed frequency of 39 GHz over a range of dielectric constants of the liquid crystal from 2.5 and 3.3. A DC bias voltage can be introduced to change the dielectric constant, thus changing the beam angle. As described herein, the dielectric constant can be changed by applying a potential difference in the volume of liquid crystal 124 using the isolated ground patches of the virtual ground 118. Thus, as shown in FIGS. 12 and 13, the antenna 100 is able to scan in left-hand and right-hand mode over a continuous frequency range and at a single frequency, over a continuous angular range, by tuning the liquid crystal through changing the dielectric constant. The disclosed configuration of the unit cell 110 enables a practical way to encapsulate the liquid crystal and to enable practical tuning of the liquid crystal.

It should be noted that FIGS. 12 and 13 show the ability of the metamaterial array 102 to scan over a continuous angular range, along one dimension (e.g., along the axis of the metamaterial array 102). The lens 108 of the antenna 100 may be controlled to control the angle of the antenna beam in an orthogonal direction, such that the overall antenna 100 may be capable of scanning over two dimensions.

The embodiments disclosed herein may provide a number of advantages compared to conventional leaky wave antenna arrays. The embodiments disclosed herein are beam steerable in two dimensions over the full available space. Compared to a conventional leaky-wave antenna arrays, the embodiments described herein are electronically beam steerable by using electrostatic control of liquid crystal. Moreover, the example antenna 100 can provide two dimensional bidirectional beam steering over a range of frequencies, or a fixed frequency, using the composite right-left-handed (CRLH) waveguide structure. The waveguide structure of antenna 100, includes a CRLH metamaterial array having two rows of LC-loaded unit cells, each row operating in opposite propagating mode (one in right-hand mode and the other in left-hand transmission mode) with a separation in array distance by approximately quarter wavelength. This has been found to result in substantially symmetrical amplitude taper and improved sidelobe performance in radiation patterns compared to a conventional uniform leaky-wave antenna. In various embodiments, the disclosed antenna 100 provides a practically realizable antenna that may enable full-space beam steering (e.g., +/−90 degrees), including the broadside angle (i.e., zero degrees), without narrowing the frequency band and without resulting in undesirably high sidelobes in the radiation patterns.

In some embodiments, antenna 100 can be incorporated into a wireless device for example mobile communication devices, satellite communication devices, wireless routers, and other wireless and telecommunication applications. The wireless devices may include additional components such as controllers for controlling operation of modules and components within the device. The devices may be used in a stationary or mobile environment. The device may also include one or more antenna controllers to control operation of the components of antenna 100. The wireless device may include additional hardware, software, firmware or a combination thereof and may include peripheral devices.

Figure 14:
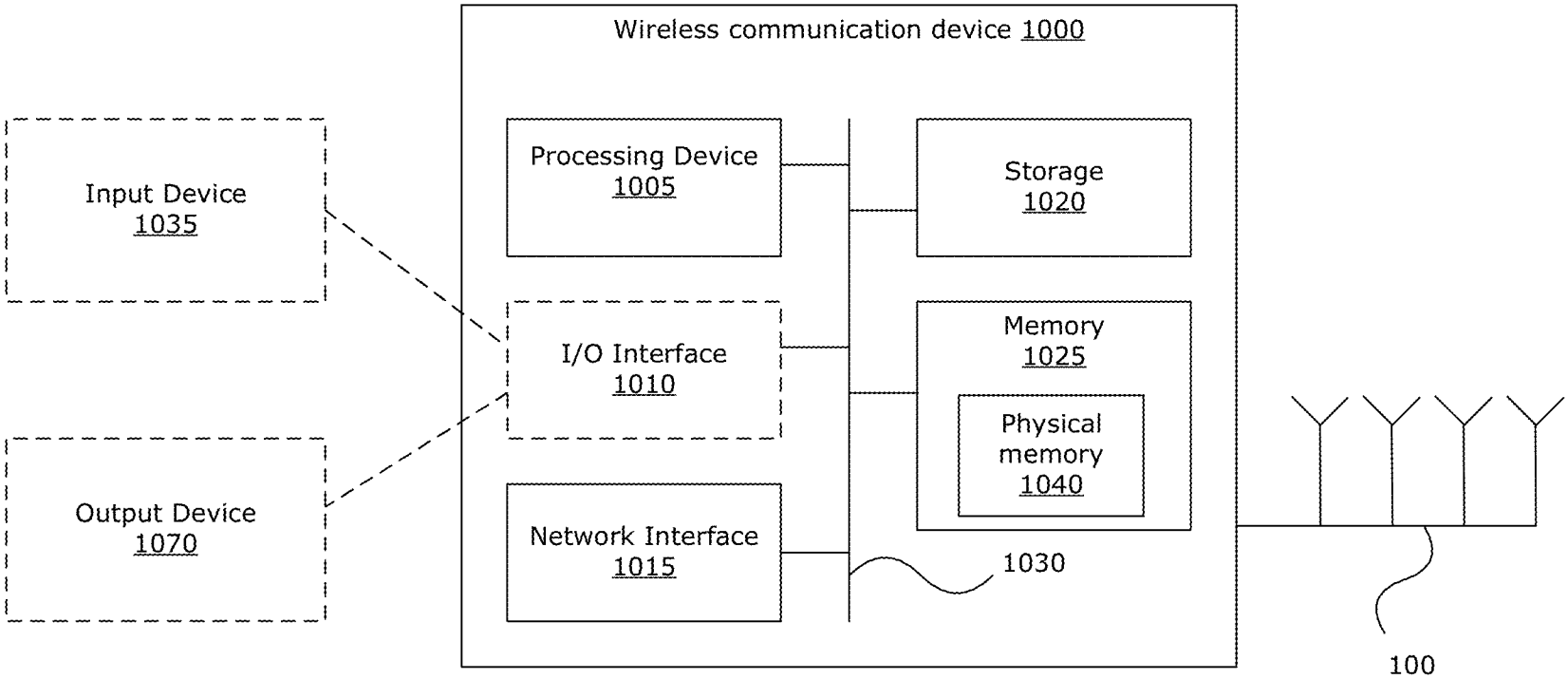
FIG. 14 is a schematic diagram of an example wireless communication device, in which an example of the disclosed antenna may be implemented.

FIG. 14 is a schematic diagram of an example wireless communication device 1000, in which examples of the antenna 100 described herein may be used. For example, the wireless communication device 1000 may be a base station, an access point, or a client terminal in a wireless communication network. The wireless communication device 1000 may be used for communications within 5G communication networks or other wireless communication networks. Although FIG. 14 shows a single instance of each component, there may be multiple instances of each component in the wireless communication device 1000. The wireless communication device 1000 may be implemented using parallel and/or distributed architecture.

The wireless communication device 1000 may include one or more processing devices 1005, such as a processor, a microprocessor, an application-specific integrated circuit (ASIC), a field-programmable gate array (FPGA), a dedicated logic circuitry, or combinations thereof. The wireless communication device 1000 may also include one or more optional input/output (I/O) interfaces 1010, which may enable interfacing with one or more optional input devices 1035 and/or output devices 1070. The wireless communication device 1000 may include one or more network interfaces 1015 for wired or wireless communication with a network (e.g., an intranet, the Internet, a P2P network, a WAN and/or a LAN, and/or a Radio Access Network (RAN)) or other node. The network interface(s) 1015 may include one or more interfaces to wired networks and wireless networks. Wired networks may make use of wired links (e.g., Ethernet cable). The network interface(s) 1015 may provide wireless communication (e.g., full-duplex communications) via an example of the disclosed antenna 100.

The wireless communication device 1000 may also include one or more storage units 1020, which may include a mass storage unit such as a solid state drive, a hard disk drive, a magnetic disk drive and/or an optical disk drive.

The wireless communication device 1000 may include one or more memories 1025 that can include a physical memory 1040, which may include a volatile or non-volatile memory (e.g., a flash memory, a random access memory (RAM), and/or a read-only memory (ROM)). The non-transitory memory(ies) 1025 (as well as storage 1020) may store instructions for execution by the processing device(s) 1005. The memory(ies) 1025 may include other software instructions, such as for implementing an operating system (OS), and other applications/functions. In some examples, one or more data sets and/or modules may be provided by an external memory (e.g., an external drive in wired or wireless communication with the wireless communication device 1000) or may be provided by a transitory or non-transitory computer-readable medium. Examples of non-transitory computer readable media include a RAM, a ROM, an erasable programmable ROM (EPROM), an electrically erasable programmable ROM (EEPROM), a flash memory, a CD-ROM, or other portable memory storage.

There may be a bus 1030 providing communication among components of the wireless communication device 1000. The bus 1030 may be any suitable bus architecture including, for example, a memory bus, a peripheral bus or a video bus. Optional input device(s) 1035 (e.g., a keyboard, a mouse, a microphone, a touchscreen, and/or a keypad) and optional output device(s) 1070 (e.g., a display, a speaker and/or a printer) are shown as external to the wireless communication device 1000, and connected to optional I/O interface 1010. In other examples, one or more of the input device(s) 1035 and/or the output device(s) 1070 may be included as a component of the wireless communication device 1000.

The processing device(s) 1005 may be used to control communicate transmission/reception signals to/from the antenna 100. The processing device(s) 1005 may be used to control beam steering by the antenna 100, for example by controlling the voltage applied to the isolated ground of the unit cells, for tuning the encapsulated liquid crystal. The processing device(s) 1005 may also be used to control the phase of the phase variable lens, in order to steer the antenna beam over a 2D plane.

The present disclosure may be embodied in other specific forms without departing from the subject matter of the claims. The described embodiments are to be considered in all respects as being only illustrative and not restrictive. Various modifications and combinations of the illustrative embodiments, as well as other embodiments of the invention, will be apparent to persons skilled in the art upon reference to the description. Selected features from one or more of the above-described embodiments may be combined to create alternative embodiments not explicitly described, features suitable for such combinations being understood within the scope of this disclosure. For examples, although specific sizes and shapes of cells 110 are disclosed herein, other sizes and shapes may be used.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology. It is therefore intended that the appended claims encompass any such modifications or embodiments.

The invention claimed is:

1. An antenna comprising:

a first substrate;

a second substrate;

a composite right- and left-handed (CRLH) metamaterial array disposed between the first and second substrates, the metamaterial array including:

at least one pair of first and second rows of unit cells, one of the first and second rows of unit cells being controllable to operate in left-hand mode, and the other of the first and second rows of unit cells being controllable to operate in right-hand mode, the at least one pair being configured to propagate a radiation pattern along a first axis;

each unit cell including a volume of liquid crystal with a controllable dielectric value and at least one isolated ground patch electrically isolated from the first and second substrates, the at least one isolated ground patch being configured as a virtual ground connection capable of generating a potential difference for tuning the dielectric value of the volume of liquid crystal;

the first and second row of unit cells being oriented end-to-end along the first axis and separated from each other by a first distance; and a phase variable liquid-crystal loaded lens provided on the CRLH metamaterial array, the lens being controllable to be phase variable along at least a second axis orthogonal to the first axis.

2. The antenna of claim 1 wherein the first or second substrate includes a ground plane of the antenna, the at least one isolated ground patch being electrically isolated from the ground plane.

3. The antenna of claim 1 wherein the CRLH metamaterial array comprises a first pair and a second pair of first and second rows of unit cells, the second pair of rows of unit cells being parallel to the first pair of rows of unit of cells, the first and second pair of rows of unit cells being separated by a second distance along the second axis.

4. The antenna of claim 3 wherein the second distance between the first and second pair of unit cells is one quarter of an operating wavelength of the antenna.

5. The antenna of claim 1 wherein the first distance between the first and second rows of unit cells of the at least one pair of unit cells is one quarter of an operating wavelength of the antenna.

6. The antenna of claim 1 wherein the lens is phase variable only along the second axis.

7. The antenna of claim 1 wherein the lens is phase variable along the first axis and is also phase variable along the second axis.

8. The antenna of claim 1 wherein the first substrate includes a copper layer.

9. A composite right- and left-handed (CRLH) metamaterial unit cell comprising:

a first substrate and a second substrate;

an intermediate region defined between the first and second substrates;

series capacitors for electrically coupling the unit cell to one or more adjacent unit cells, and parallel inductors for electrically coupling the unit cell to ground;

the series capacitors and parallel inductors together forming a composite right- and left-hand metamaterial structure;

a volume of liquid crystal located in a cavity disposed within the intermediate region; and at least one electrically isolated ground patch, the at least one isolated ground patch being electrically isolated from ground and configured as a virtual ground connection capable of generating a potential difference in the volume of liquid crystal.

10. The unit cell of claim 9 wherein the series capacitor is one of a planar capacitor, a circular capacitor, an interdigital capacitor, or a series-oriented parallel plate capacitor.

11. The unit cell of claim 9 wherein the parallel inductor has two open ends in two terminals of the inductor.

12. A wireless communication device comprising:

an antenna for receiving and transmitting wireless signals, the antenna including:

a first substrate;

a second substrate;

a composite right- and left-handed (CRLH) metamaterial array disposed between the first and second substrates, the metamaterial array including:

at least one pair of first and second rows of unit cells, one of the first and second rows of unit cells being controllable to operate in left-hand mode, and the other of the first and second rows of unit cells being controllable to operate in right-hand mode, the at least one pair being configured to propagate a radiation pattern along a first axis;

each unit cell including a volume of liquid crystal with a controllable dielectric value and at least one isolated ground patch electrically isolated from the first and second substrates, the at least one isolated ground patch being configured as a virtual ground connection capable of generating a potential difference for tuning the dielectric value of the volume of liquid crystal;

the first and second row of unit cells being oriented end-to-end along the first axis and separated from each other by a first distance; and a phase variable liquid-crystal loaded lens provided on the CRLH metamaterial array, the lens being controllable to be phase variable along at least a second axis orthogonal to the first axis; and a processing device for providing control signals to the antenna, the control signals enabling tuning of the volume of liquid crystal, to control direction of a beam of the antenna along the first axis; and the control signals enabling control of the lens, to control direction of the beam along the second axis.

13. The wireless communication device of claim 12 wherein, in the antenna, the first or second substrate includes a ground plane of the antenna, the at least one isolated ground patch being electrically isolated from the ground plane.

14. The wireless communication device of claim 12 wherein, in the antenna, the CRLH metamaterial array comprises a first pair and a second pair of first and second rows of unit cells, the second pair of rows of unit cells being parallel to the first pair of rows of unit of cells, the first and second pair of rows of unit cells being separated by a second distance along the second axis.

15. The wireless communication device of claim 14 wherein, in the antenna, the second distance between the first and second pair of unit cells is one quarter of an operating wavelength of the antenna.

16. The wireless communication device of claim 12 wherein, in the antenna, the first distance between the first and second rows of unit cells of the at least one pair of unit cells is one quarter of an operating wavelength of the antenna.

17. The wireless communication device of claim 12 wherein, in the antenna, the lens is phase variable only along the second axis.

18. The wireless communication device of claim 12 wherein, in the antenna, the lens is phase variable along the first axis and is also phase variable along the second axis.

* * * * *